US005223829A

United States Patent [19]

Watabe

[11] Patent Number: 5,223,829

[45] Date of Patent: Jun. 29, 1993

[54] ELECTRIC LOCKER APPARATUS WITH AUTOMATIC LOCKER BOX DESIGNATION DEVICE

[75] Inventor: Hideto Watabe, Tokyo, Japan

[73] Assignee: Cleanup Corporation, Tokyo, Japan

[21] Appl. No.: 727,077

[22] Filed: Jul. 9, 1991

[30] Foreign Application Priority Data

Oct. 31, 1990 [JP] Japan ..... 2-292058

[51] Int. Cl.[5] ..... G06F 7/04; G06K 7/01; H01H 47/00; G08B 13/14

[52] U.S. Cl. ..... 340/825.31; 235/382.5; 361/172; 340/568; 364/478

[58] Field of Search ..... 340/825.31, 825.35, 340/825.3, 568, 569, 570, 825.34; 235/382, 382.5, 375, 385; 194/239, 247, 218, 350; 186/66; 70/265; 361/172; 200/DIG. 3; 312/215, 242; 364/478, 479; 250/568; 358/85, 108

[56] References Cited

U.S. PATENT DOCUMENTS 4,636,634 1/1987 Harper et al. ..... 235/385
4,894,717 1/1990 Komei ..... 358/85
5,126,732 6/1992 Mardon ..... 340/825.31

FOREIGN PATENT DOCUMENTS 62-281100 12/1987 Japan .
64-57372 4/1989 Japan .
64-57373 4/1989 Japan .

*Primary Examiner*—Donald J. Yusko
*Assistant Examiner*—R. Gray
*Attorney, Agent, or Firm*—Dvorak and Traub

[57] ABSTRACT

An electric locker apparatus to be installed at a public space, such as entrance hall of a condominium, includes a plurality of locker boxes of at least one type, each having a door with an electric lock device, and a sensor for detecting whether the relevant locker box is occupied by an article or empty. An improved locker box designating device serves to automatically designate an empty locker box of a desired type such that any one of the locker boxes of a same type, after it has been once used, can be designated only after subsequent one-round use of all remaining locker boxes of the same type. The lock device of the designated locker box is actuated to unlock the door, for allowing an article to be accommodated in the locker box. All the locker boxes of a same type are thus put into use with as uniform a frequency as possible.

15 Claims, 5 Drawing Sheets

ELECTRIC LOCKER APPARATUS WITH AUTOMATIC LOCKER BOX DESIGNATION DEVICE

BACKGROUND OF THE INVENTION

1. Field of the Invention

The present invention relates generally to an electric locker apparatus including a plurality of locker boxes; more particularly, it pertains to an improvement in a locker box designating device for such locker apparatus, which serves to automatically designate a locker box to be occupied thereby allowing all the locker boxes of a same type to be occupied with a uniform frequency.

2. Description of the Related Art

A locker apparatus with a plurality of locker boxes of various sizes or types is often installed at a public space such as an entrance hall of a condominium, and used typically by registered residents or the like users to receive baggages, etc., delivered during a period when the recipient is out of house, or to transfer various articles rom residents to courier or laundry service agent, etc. This kind of locker apparatus generally includes a console box accommodating an electric control unit for controlling the operations of each locker box, and having a front operation panel equipped with an operation guidance display, ten-keys, etc.

While such a locker apparatus proved to be generally satisfactory in improving users' daily convenience, it has been confirmed that every locker boxes of the apparatus are not actually occupied with a uniform frequency. There are certain locker boxes which are located close to the operation panel and/or at a convenient height, and which are thus more readily accessible and tend to be used with a higher frequency than other locker boxes. This tendency is quite significant in the case of a locker apparatus wherein the size or type of a locker box to be used is selected by user's designation, i.e. input of the locker box number through ten-keys. It is of course that repeated occupation, with a higher frequency, of such particular locker boxes may result in their premature damages, possibly giving rise to undesirable shortening of the serviceable life of the entire apparatus.

There has been a proposal wherein a locker box of a selected type is automatically designated for use in order to avoid the user's free choice. This proposal is that locker boxes of a same size or type are previously assigned with respective serial natural numbers and the designation is made of the box having the youngest number among the boxes of the selected type which are ready to be used or which are not occupied. This proposal proved to be quite effective when all the locker boxes are substantially fully in operation at any time, as every boxes are then used with a substantially uniform frequency. However, when only a limited number of locker boxes are usually put in use due, for example, to a small number of articles or baggages to be transferred through locker boxes to or from the residents, it is still practically impossible to achieve a uniform use of the locker boxes. In such a case, the locker box of the youngest number is always in use while the boxes of elder number are scarcely used.

SUMMARY OF THE INVENTION

It is therefore an object of the present invention to eliminate or at least mitigate the above-mentioned drawbacks of the prior art, and to provide a locker apparatus including an improved locker box designating device which allows all the locker boxes of a same type to be occupied with as uniform a frequency as possible.

The present invention includes a number of lockers whose occupation (i.e. the storage of articles) is cycled consecutively, so that when each of the plurality of lockers is occupied once in a given cycle, the cycle begins again. Consequently, each locker is occupied, at most, once more than the other lockers in the cycle during their lifetimes to reduce wear or damage. The invention may designate a particular locker any number of times in a row after all the other lockers have been occupied (including simple testing by the manufacturer or the like) as little as once.

According to one aspect of the present invention, there is provided an electric apparatus to be installed at a public space, which comprises: a plurality of locker boxes of at least one type, each locker box having a door with an electric lock device, and a sensor for detecting whether the relevant locker box is occupied by an article or empty; means for automatically designating an empty locker box of a desired type such that any one of the locker boxes of a same type after it has been once used, can be designated only after subsequent use of all remaining locker boxes of the same type; and means for actuating the lock device of the designated locker box to unlock the door, thereby allowing an article to be accommodated in the locker box.

According to another practical aspect of the present invention, there is provided a locker apparatus which comprises: an electric power supply including a main switch; a plurality locker boxes of two or more types, each locker box having an electric lock device and a sensor for detecting whether the relevant locker box is occupied by an article or empty, said locker boxes being assigned with respective box numbers of successive natural numbers which are independent from the type of the locker box; locker box type selection means for manually selecting the type of the locker box, depending upon size of an article to be accommodated in a locker box; locker box designation means for successively retrieving the locker boxes and designating an empty locker box of the selected type which is to be used to accommodate the article therein, such that any one of the locker boxes of a same type, after it has been once used, is designated only after subsequent use of all remaining locker boxes of the same type; and a control unit for permitting the designated locker box of the selected type to be opened to accommodate an article, by controlling its electric lock upon coincidence of an input identification code with a data stored in the control unit.

Preferably, the locker box designation means comprises: a locker box retrieving counter; a locker box number counter; means operative when a successively retrieved locker box is not of the selected type or is currently in use, for carrying out a first step wherein, starting from an initial count value "0" of the retrieving counter, a value "1" is successively added to the count value of the retrieving counter; means operative when the number of the retrieved locker box exceeds the total number of the locker boxes, for indicating that no locker box is currently available; means for carrying out a second step for temporarily designating a locker box, wherein count value of the locker box number counter is set to "0" when the electric main switch of the locker apparatus is turned-on, and the count value of the locker box number counter is added with "1" each time a locker box has been retrieved to store the locker box number of most recently designated locker box and read-out the stored locker box number upon a subsequent locker box retrieval, and wherein the count value of the locker box number counter is set to "1" when the count value of the locker box number counter exceeds total number of the locker boxes to continue addition of "1" to the count value of the locker box number counter; means operative when the temporarily designated locker box is either occupied by an article or is of a type which is different from the selected one, for returning to said first step and adding "1" to the count value of the retrieving counter, and for successively retrieving the locker box numbers as many times as the count value of the locker box number counter exceeds the total number of the locker boxes; and means for definitely designating a locker box by confirming that the temporarily designated locker box is empty and is of a selected type.

With the above-mentioned novel arrangement of the locker apparatus according to the present invention, assuming for example that all the locker boxes are assigned with serial natural numbers as the box numbers, the locker box of a desired type and having the youngest box number is designated at first and used to accommodate an article therein. Then, even when the article has been taken-out and the locker box of the youngest box number becomes empty, this locker box is not the one which is subsequently designated. That is, an automatic designation for a subsequent use is made of a locker box of the same type but having the second youngest box number. In this manner, the locker box of a desired type and having a predetermined box number is designated only after subsequent one-round use of all the locker boxes of the same type.

It is thus possible to automatically designate a locker box of selected type without user's free choice, thereby allowing all the locker boxes of the same type to be put into use with a substantially uniform frequency, effectively preventing premature damages of the locker boxes, and making it possible to prolong the serviceable life of the entire apparatus.

BRIEF DESCRIPTION OF THE DRAWINGS

The present invention will be explained hereinafter with reference to the attached drawings, wherein.

DETAILED DESCRIPTION OF THE PREFERRED EMBODIMENT

Figure 1:
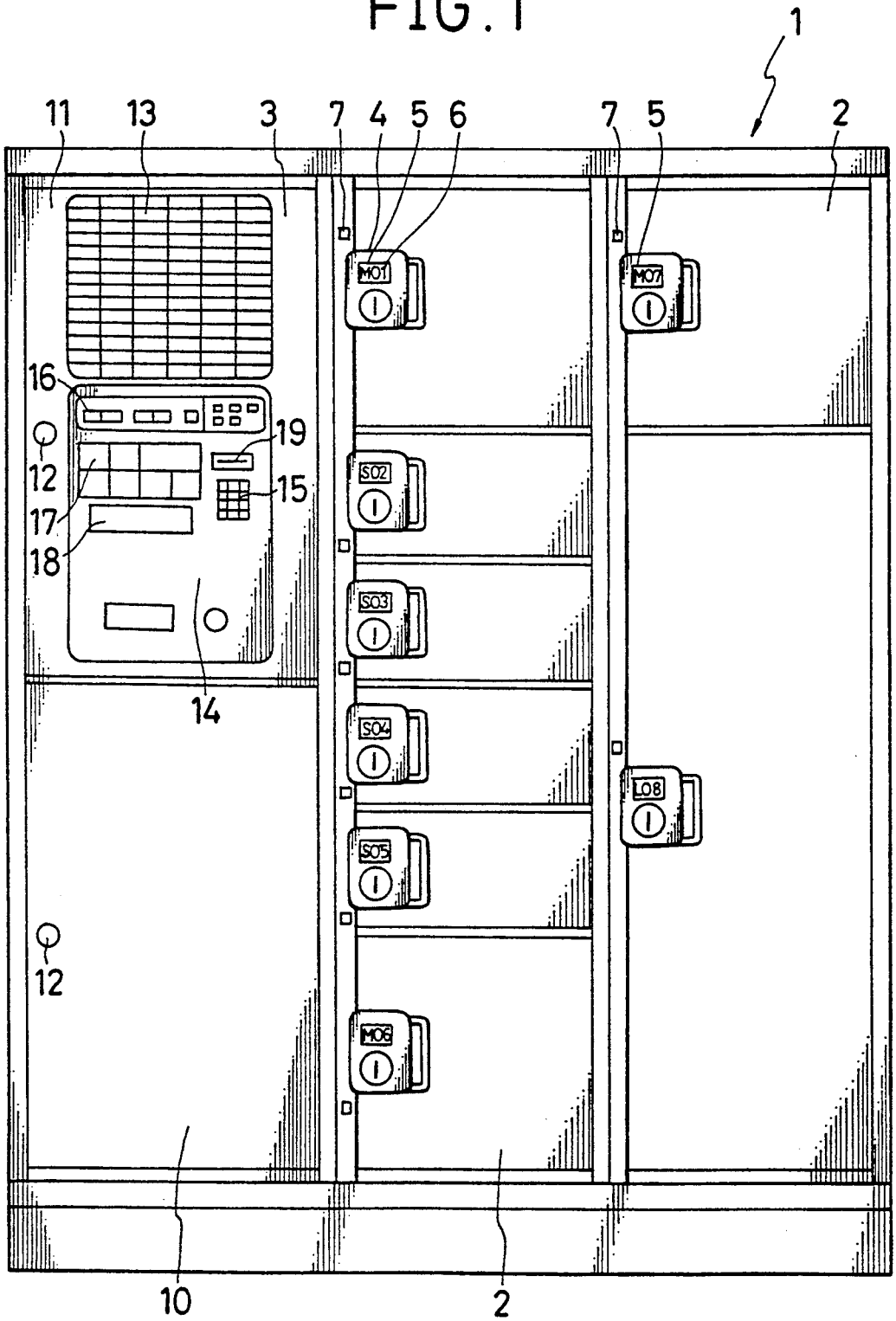
FIG. 1 is a front view of a locker apparatus according to one embodiment of the present invention.

There is shown in FIG. 1 one example of an electric locker apparatus according to the present invention, which is denoted as a whole by reference numeral 1. The apparatus 1 is typically installed at the entrance hall of a multistory building or condominium, and serves to automatically manage transfer of baggages or the like, which are to be delivered to or dispatched from registered residents even when they are out of their houses. It has to be noted in this connection that the term "house" is used herein in its broadest sense, and collectively includes not only a self-contained house in a restricted sense, but also a single room, compartment, dwelling unit which is composed of a plurality of rooms and/or compartments, etc., in the case of a condominium.

The apparatus 1 includes a plurality of locker boxes 2 of various types depending upon capacity or size. Each locker box 2 has a front door which is equipped with an electric lock device, not shown. The lock device may be of a conventional solenoid-operated type, which normally assumes a locked state to maintain the door in its closed position, and which can be brought into unlocked state by supplying electric current to the solenoid, thereby allowing the door to be opened. As such a lock device is known, per se, a further detailed explanation will not be necessary. Each locker box 2 incorporates a content sensor not shown, for detecting whether it is empty or already occupied by an article.

The apparatus further includes a console box 3 accommodating an electric control unit for controlling operations o the locker boxes 2. As will be more fully explained hereinafter, the control unit is connected to the baggage sensors and the electric lock devices of all the boxes, and serves to designate a locker box of a selected type for use, to control opening or closure of the designated box, and also to store information of use records, etc.

In the illustrated embodiment, there are arranged two vertical rows of the locker boxes, of which the left side row is formed of two medium-sized boxes and four small-sized boxes therebetween, while the right side row is formed of a medium-sized box and a large-sized box. Each locker box 2 is provided on its door with a knob 4 which bears an indication 5 of the box type, i.e. S, M or L respectively for small, medium or large type, and an indication 6 of locker box number which is a serial natural number 01, 02, . . . 07, 08 assigned to the box independently of its type. Thus, using these indications 5 and 6, the locker boxes 2 may be identified as M01, S02, S03, S04, S05, M06, M07 and L08, respectively. The locker boxes 2 on their vertical side frame members are provided with unlock-indication lamps 7, each being arranged adjacent to the knob 4 of a relevant locker box 2, and turned ON when the lock device of that box 2 is switched into an unlocked state.

The console box 3 accommodating the above-mentioned control unit 10 has a lower section provided with a front door 11 which can be opened by inserting a predetermined main key (not shown) into a keyhole 12 so as to permit maintenance and/or exchange of components for repair to be performed in a facilitated manner. The console box 3 has an upper section provided with a display panel 13 for indicating the house number of the resident to whom baggages or the like articles have been delivered and stored in the locker boxes 2. Thus, the residents in front of the locker apparatus 1 can readily ascertain if it is necessary to pickup delivered articles.

The upper section of the console box 3 further includes an operation panel 14 which is provided with ten-keys 15, function keys 16 in the form of various push buttons **16*a*–16*h*, an operation guidance display 17, a further display 18, a card slot 19 for a card reader, coin inlet 20 and outlet 21 for inserting or returning coins when prescribed amount of fee is to be charged in using the apparatus, a slot 22** for a voucher to be stamped for certification purposes, etc.

More particularly, the function keys 16 include, as selection buttons to be selectively pushed by an user in the first step, a delivery key 16*a* and a take-out key 16*b* both for delivery agents, a take-out key 16*c* and a delivery or dispatch request key 16*d* both for residents, and a common cancel key 16*e* for cancelling a false key operation. A "#" key included in the ten-keys 15 can be used as a confirmation key 16*f* which is pushed after user's confirmation of correct numbers, etc., in order to further proceed into a subsequent operation step. There are further provided box-type selection keys 16*g* bearing indication of the box type S, M or L for selecting a desired type of the box 2 which the user intends to use depending upon the size of the baggages or the like to be accommodated in the box, as well as a stamp key 16*h* for applying a voucher with a certificate stamp after completion of all the necessary procedures. The stamp key 16*h* is arranged just above the voucher slot 22.

The operation guidance display 17 may be divided into a plurality of sections for displaying texts and visual images explaining the operation procedures of the apparatus 1. Each section of the display 17 may have a backlight illumination device which is turned ON when the procedure displayed by that section is to be taken subsequently or is being taken. This display 17 may be combined with an audio guidance by means of an artificial voice, if desired. Furthermore, the display 18 is composed of a suitable display element such as cathode ray tube (CRT), liquid crystal display (LCD), fluorescent or electroluminescent display tube or the like, and is for indicating the house number, etc., which has been inputted by the user through the ten-keys 15.

It is assumed that the administrator and registered residents are previously assigned with respective registration cards in the form of a magnetic memory in which necessary information are stored, such as the house number of each resident, ID number for matching the house number with the locker box of the apparatus, etc. The registration card may alternatively be an IC card with a higher information storage capacity.

Figure 3:
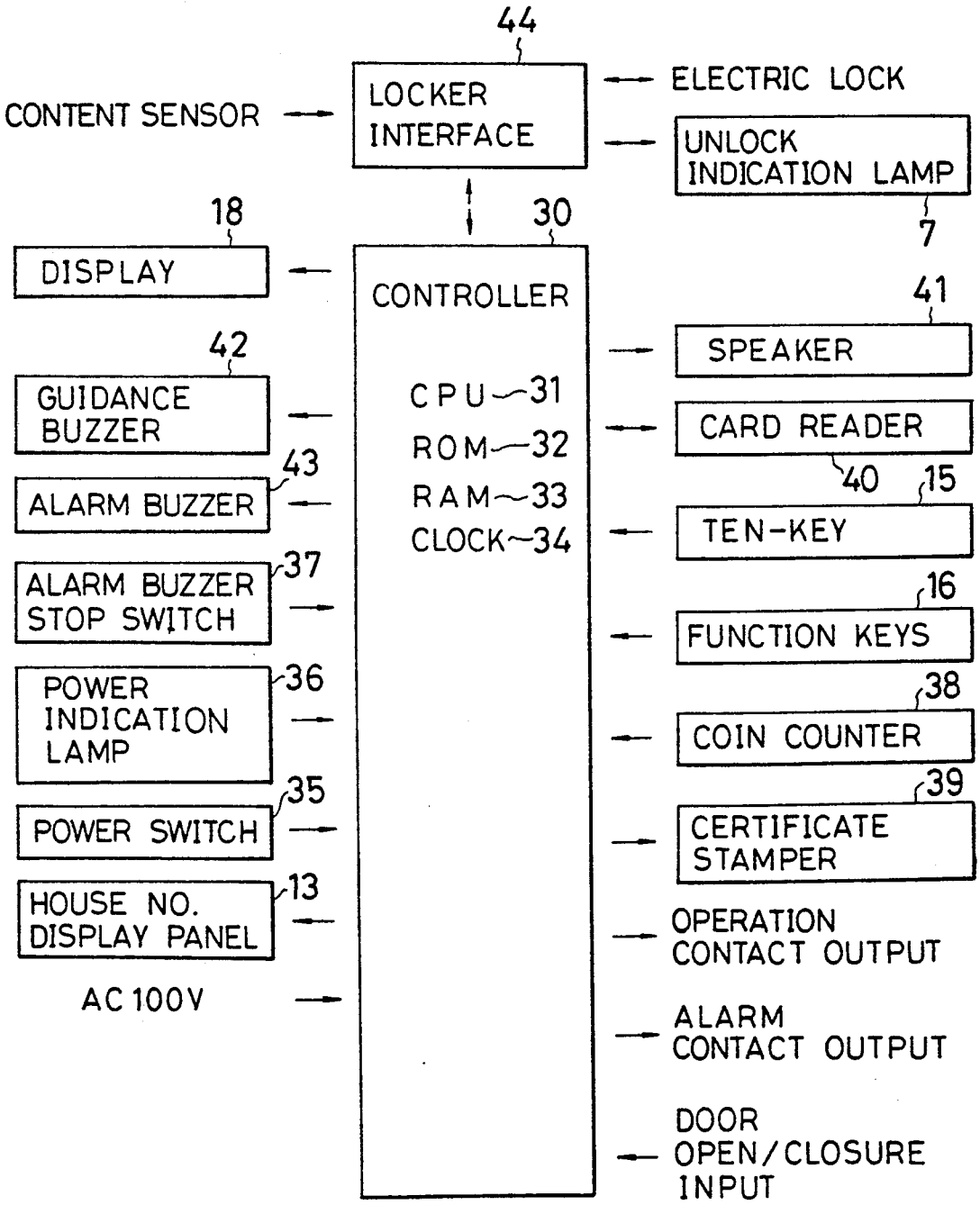
FIG. 3 is a block diagram of the control unit.

One preferred embodiment of the control unit 10 for the locker apparatus 1 according to the present invention will be explained below with reference to a block diagram shown in FIG. 3. The control unit 10 is illustrated as a controller 30 including a central processing unit (CPU) 31, a read-only memory (ROM) 32, a random-access memory (RAM) 33 and a clock 34, which are connected to various peripheral appliances through appropriate interfaces.

The ROM 32 stores a program which serves to control the operation of the entire locker apparatus 1, and also stores data memories for the information of each registration card and the users' passwords and/or identification codes or ID numbers. The use record of the locker apparatus 1 (locker box numbers, identification of recipients, date and time of use, etc.) is stored in the RAM 33 which may be in the form of a RAM card to permit print-out of the stored information by means of an external printer (not shown), whenever necessary. The clock 34 serves to control the length of the period in which a designated locker box is opened, and to monitor the time length of use.

The peripheral appliances which are connected to the controller 30 include the above-mentioned ten-keys 15, function keys 16, displays 17, 18, electric lock device, baggage sensor and unlock indication lamps 7. The peripheral appliances further include an electric power switch 35, a power switch indication lamp 36, an alarm interruption switch 37, a coin counter 38, a stamper 39 for the voucher, a card reader 40, a loudspeaker 41 for an audio operation guidance, a guidance buzzer 42, an alarm buzzer 43, and an interface 44 for the electric lock device, content sensor and unlock-indication lamps 7.

The locker apparatus 1 can be used to receive an article, such as a baggage, washed clothes, etc., which has been delivered by courier or laundry agent to a resident who is out of house and to dispatch a baggage or the like through courier agent or deliver clothes to laundry agent for washing. To this end, it is necessary for the user to push either the delivery key 16*a* or the delivery or dispatch request key 16*d*, and to manually select the type S, M or L of the locker box 2 depending upon the size of the article to be accommodated in the box. The locker box 2 of the selected type is then automatically designated according to a predetermined sequence of the locker box number 6.

Figure 4:
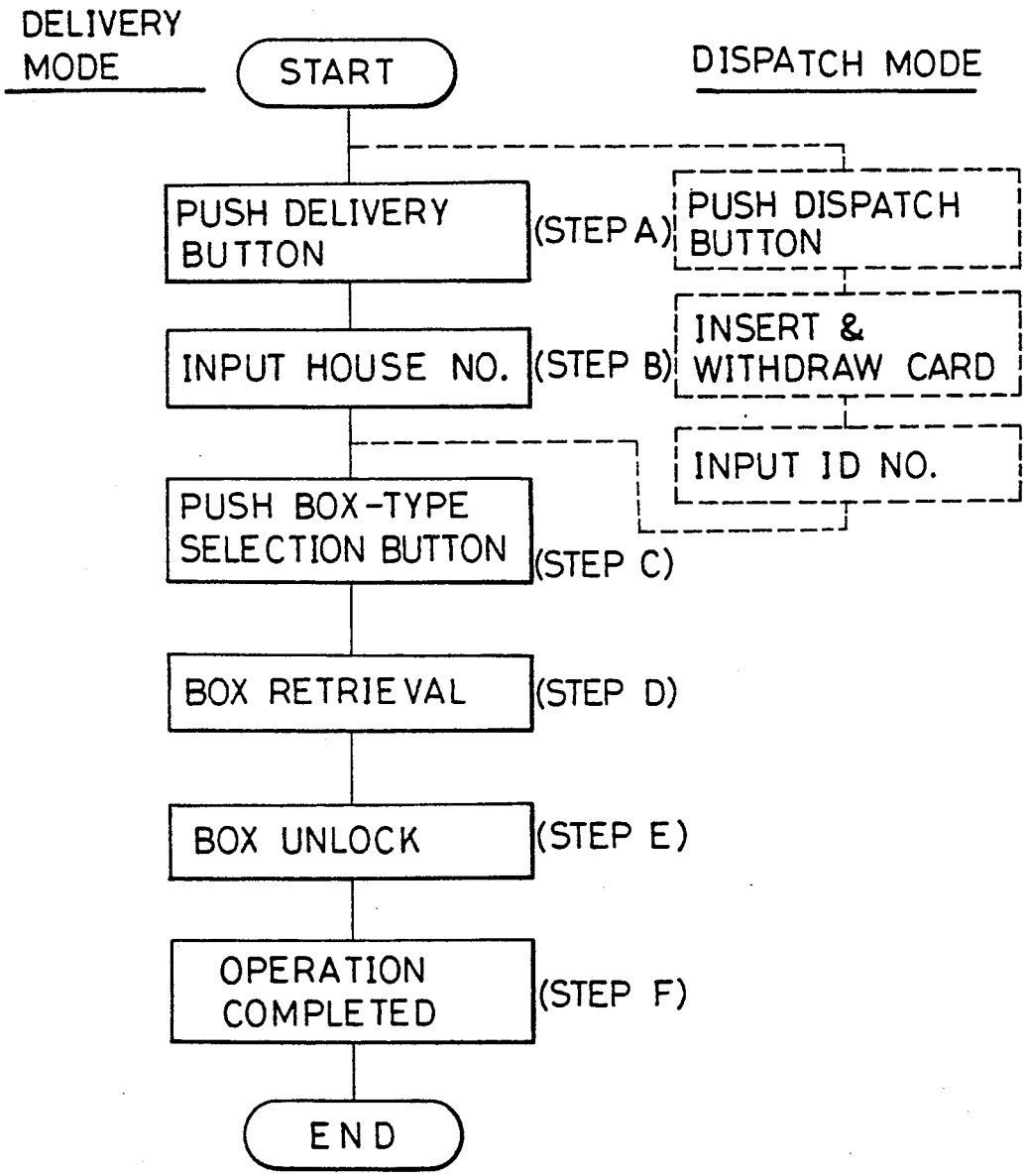
FIG. 4 is a flow chart of a series of operations required to accommodate an article in a locker box or to take out the article therefrom.

When, as a typical example, a courier agent intends to deliver a baggage to a resident who is out of house, the operations of the locker apparatus 1 to be performed are as shown in the flow chart of FIG. 4. In this instance, the courier agent may be assumed to be aware, by some means or other, of the absence of the resident to whom the baggage is to be delivered; otherwise, the resident may wish to directly receive the delivered baggage from the agent. Thus, the courier agent as the user stands in front of the operation panel 14 and pushed the deliver key 16*a*, inputs the house number of the resident through the ten-keys 15 and then pushes one of the box-type selection keys 16*g* to select the type S, M or L of the locker box 2 depending upon the size of the baggage. Each time a key operation has been confirmed to be correct, the user pushed the confirmation key 16*f* (#). If not, i.e., in the case of an erroneous input, the cancellation key 16*e* is pushed to perform the key operation once again.

The locker box to be used for accommodating the baggage is now automatically designated in the manner to be fully explained hereinafter, and the electric lock device of the designated locker box is turned into an unlocked state. The box number of the designated locker box can be confirmed by the display 18 and also by the indication lamp 7. Thus, the courier agent is allowed to open the door of the designated locker box, to place the baggage inside of the box, and to close and automatically lock the door. On this occasion, if necessary, a voucher is inserted into the slot 22 and the stamp key 16*h* then is pushed such that the voucher is applied with a deliver certificate stamp by means of the stamper 39. By this, all the necessary operations to be performed by the courier agent are completed.

When an article has been delivered and accommodated in a locker box 2, the house number of the recipient of the article, who is a registered resident, is displayed on the display panel 13 so that the resident can readily ascertain that the article has to be taken out. To this end, the resident pushes the take-out key 16*d* and then inserts the registration card into the card reader 40. By this, as soon as the identification of the resident has been confirmed, the door of the relevant locker box is unlocked and the unlocked state of the locker box can be confirmed by the display 18 and the indication lamp 7. Thus, the locker box is opened and the article accommodated therein is taken-out by the resident.

One preferred example of the locker box designation procedures in the locker apparatus according to the present invention will be explained hereinafter, by referring to a flow chart shown in FIG. 5. It is assumed that after the apparatus has been installed in place and the registration cards have been properly distributed to every registered users, the electric power switch is turned ON. Then, the RAM 33 stores the locker box number "0" and the total number of the locker boxes (MAX).

In subsequently using the locker apparatus, as soon as the desired locker box type S, M or L has been manually selected by pushing one of the selection keys 16*g*, the automatic locker box retrieval/designation procedures are carried out. Upon commencement of the automatic locker box retrieval/designation procedures, a counter (CNT) is always set to "0".

The counter (CNT) is then added with "1" (CNT+1). In this connection, if the counter value is greater than the total number of the locker boxes (MAX), all the locker boxes are assumed to be in use, and an announcement to that effect by means of artificial voice is made and the procedures are stopped. This is because, despite retrieval of the locker boxes as many times as the total number of the locker boxes, it is impossible to find out a locker box of a desired type which is not in use.

When the counter value is smaller than the total number of the locker boxes (MAX), a temporary designation is made of a locker box with a box number which corresponds to next one of the box number stored in the RAM 33, i.e. the sum of the stored box number further added with "1". The box number of each locker box, as mentioned hereinbefore, is a serial natural number and ranges from 01 to 08 in the embodiment illustrated in FIG. 1. On the other hand, the locker box number initially stored in the RAM 33 is set to "0" upon the initial start of the apparatus, i.e. each time the electric power switch is turned ON, as mentioned hereinbefore. Furthermore, the locker box number normally stored in the RAM 33, during the operation of the apparatus other than the initial start, corresponds to the number of the locker box which has been most recently designated or unlocked. If the number of the temporarily designated locker box is greater than the total number of the locker boxes (MAX), the locker box number which has been previously stored in the RAM 33 is cancelled, and the RAM 33 stores the locker box number "1". This is because there are various types of the locker boxes and, besides, a locker box which does not exist cannot be designated and it thus becomes necessary to retrieve an available locker box from the locker box of the number 01.

When the number of the temporarily designated locker box is smaller than the total number of the locker boxes (MAX), a judgement is then made as to whether the type of the temporarily designated locker box is the selected one. If the type of the temporarily designated locker box has not been judged as being the selected one, the procedure is returned to the step wherein the value of the counter (CNT) is added with "1" (CNT+1), to further retrieve available locker boxes.

If, on the other hand, the type of the temporarily designated locker box has been judged as being the selected one, another judgement is then made as to whether the door of the locker box is closed. Furthermore, if the door of the temporarily designated locker box has been judged as being closed, still another judgement is then made as to whether the locker box is occupied by a baggage or the like article which has not yet been taken out.

If the temporarily designated locker box has been judged as being empty and unoccupied by an article, the locker box is assumed to be available and is thus definitely designated. Thus, the electric lock device of the designated locker box is supplied with an electric current so that the solenoid of the lock device is moved into an unlocked position. The unlocked state of the designated locker box is indicated by the lamp 7 adjacent to the lock device, so that the user is permitted to open the door, accommodate an article inside of the locker box, and close the door to lock the locker box.

If, however, the door of the temporarily designated locker box of the selected type has been judged as being open, or if the temporarily designated locker box of the selected type, with its door closed, has been judged as being occupied by an article, the procedure is returned to the step wherein the value of the counter (CNT) is added with "1" (CNT+1), to further retrieve available locker boxes. It is assumed here that the electric lock device, per se, is of a conventional kind wherein it is normally maintained in its locked state. Hence, the locked state o the temporarily designated locker box is an indication of failure o the lock device. Moreover, occupation of the temporarily designated locker box by an article is an indication that the locker box is being in use. In this connection, the presence or absence of an article in a locker box 2 is judged by comparing the use record of the relevant box with the output of the baggage sensor within the box 2.

Figure 2:
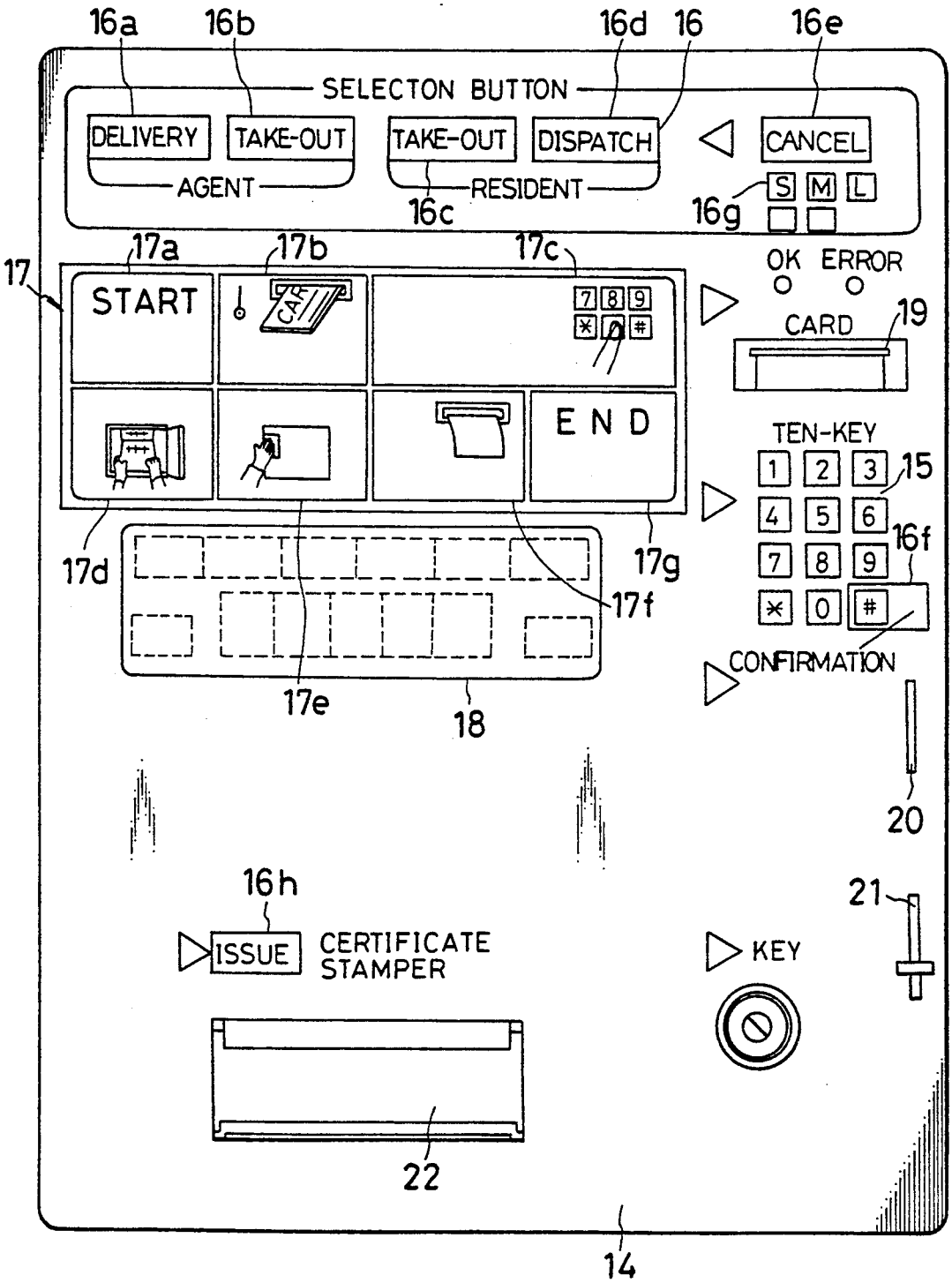
FIG. 2 is a detailed view of the operation panel.

In order to clearly indicate the above-mentioned successive operation procedures for the convenience of users, the operation guidance display 17 in the embodiment shown in FIGS. 1 and 2 is divided into seven sections 17*a*–17*g* each of which may bear the following instructions, for example.

Section 17*a*:
START; Push One Selection Button
Section 17*b*:
Insert and Withdraw Registration Card
Section 17*c*:
Input House No. and Confirm (#)
Input Box No. and Confirm (#)
Input Password No. and Confirm (#)
Input ID No. and Confirm Key (#)
Section 17*d*:
Open Box of Designated No. and Accommodate/-Take-out Article
Section 17*e*:
Close Door Tight
Section 17*f*:
Insert Voucher into Slot
Section 17*g*:
END; Operations Completed Some aspects of the operation procedures and the arrangement and/or structure of the electric locker apparatus are disclosed, e.g. in U.S. Pat. No. 4,894,717, Japanese Patent Application Laid-open Publication No. 62-281,100 and Japanese Utility Model Application Laid-open Publication Nos. 64-57,372 and 64-57,373, whose disclosures are expressly incorporated herein by reference.

For the sake of clarity, some practical use examples will be explained below. In this connection, it is assumed that all the locker boxes are initially empty, and the power switch 35 has just been turned ON with the RAM 33 storing the locker box number "0".

EXAMPLE 1

A courier service agent A intends to deliver a baggage to a resident whose house number is 101.

(A) The agent A pushes the delivery key 16*a* (step A).

(B) The agent A pushes the house number 101 by the ten-keys 15, and further pushes the confirmation key 16*f* (step B).

(C) The agent A selects a locker box of the medium type M and pushes the selection key 16*g* corresponding to the type M (step C).

(D) Locker box retrieval (step D):

1) The locker box counter (CNT) is set to "0".

2) The counter value (CNT=0) is added with "1" (CNT=0.1=1).

3) The counter value (CNT=1) is judged to be smaller than the total number 8 of the locker boxes.

4) The locker box number (0) is added with "1" (BOX No.=0+1=1)

5) The locker box number (01) is judged to be smaller than the total number 8 of the locker boxes.

6) Judgement is made as to whether the locker box 01 is of the type M selected in the step (C). The locker box 01 is judged to be of the type M.

7) Judgement is made as to whether the door of the locker box 01 is closed. The door is judged to be closed.

8) Judgement is made as to whether the locker box 01 is occupied by an article. The locker box 01 is judged to be empty.

(E) The locker box 01 is unlocked (step E).

(F) The door of the locker box 01 is opened, and the baggage to be delivered is accommodated in the box and the door is closed to complete the delivery operation (step F).

(G) The baggage is ready to be taken-out by the resident of the house number 101, and the locker box number 01 is stored.

EXAMPLE 2

Another courier service agent B intends to deliver a baggage to a resident whose house number is 201.

(A) The agent B pushes the delivery key 16*a* (step A).

(B) The agent B pushes the house number 201 by the ten-keys 15, and further pushes the confirmation key 16*f* (step B).

The agent B selects a locker box of the medium type M and pushes the selection key 16*g* corresponding to the type M (step C).

(D) Locker box retrieval (step D):

1) The locker box counter (CNT) is set to "0".

2) The counter value (CNT=0) is added with "1" (CNT=0+1=1).

3) The counter value (CNT=1) is judged to be smaller than the total number 8 of the locker boxes.

4) The locker box number (1) is added with "1" (BOX No.=1+1=2)

5) The locker box number (02) is judged to be smaller than the total number 8 of the locker boxes.

6) Judgement is made as to whether the locker box 02 is of the type M selected in the step (C). The locker box 02 is judged to be of the type S.

7) Return to 2) to add the counter value (CNT=1) with "1" (CNT=1+1=2).

8) The counter value (CNT=2) is judged to be smaller than the total number 8 of the locker boxes.

9) The locker box number (2) is added with "1" (BOX No.=2+1=3).

10) The locker box number (03) is judged to be smaller than the total number 8 of the locker boxes.

11) Judgement is made as to whether the locker box 03 is of the type M selected in the step (C). The locker box 03 is judged to be of the type S.

12) Return to 2) to add the counter value (CNT=2) with "1" (CNT=2+1=3).

13) The counter value (CNT=3) is judged to be smaller than the total number 8 of the locker boxes.

14) The locker box number (3) is added with "1" (BOX No.=3.1=4).

15) The locker box number (04) is judged to be smaller than the total number 8 of the locker boxes.

16) Judgement is made as to whether the locker box 04 is of the type M selected in the step (C). The locker box 04 is judged to be of the type S.

17) Return to 2) to add the counter value (CNT=3) with "1" (CNT=3+1=4).

18) The counter value (CNT=4) is judged to be smaller than the total number 8 of the locker boxes.

19) The locker box number (4) is added with "1" (BOX No.=4.1=5).

20) The locker box number (05) is judged to be smaller than the total number 8 of the locker boxes.

21) Judgement is made as to whether the locker box 05 is of the type M selected in the step (C). The locker box 05 is judged to be of the type S.

22) Return to 2) to add the counter value (CNT=3) with "1" (CNT=4+1=5).

23) The counter value (CNT=5) is judged to be smaller than the total number 8 of the locker boxes.

24) The locker box number (5) is added with "1" (BOX No.=5.1=6).

25) The locker box number (06) is judged to be smaller than the total number 8 of the locker boxes.

26) Judgement is made as to whether the locker box 06 is of the type M selected in the step (C). The locker box 06 is judged to be of the type M.

27) Judgement is made as to whether the door of the locker box 06 is closed. The door is judged to be closed.

28) Judgement is made as to whether the locker box 06 is occupied by an article. The locker box 06 is judged to be empty.

(E) The locker box 06 is unlocked (step E).

(F) The door of the locker box 06 is opened, and the baggage to be delivered is accommodated in the box and the door is closed to complete the delivery operation (step F).

(G) The baggage is ready to be taken-out by the resident of the house number 201, and the locker box number 06 is stored.

EXAMPLE 3

Another courier service agent C intends to deliver a baggage to a resident whose house number is 301.

(A) The agent C pushes the delivery key 16*a* (step A).

(B) The agent C pushes the house number 301 by the ten-keys 15, and further pushes the confirmation key 16*f* (step B).

(C) The agent C selects a locker box of the medium type M and pushes the selection key 16*g* corresponding to the type M (step C).

(D) Locker box retrieval (step D):

1) The locker box counter (CNT) is set to "0".

2) The counter value (CNT=0) is added with "1" (CNT=0.1=1).

3) The counter value (CNT=1) is judged to be smaller than the total number 8 of the locker boxes.

4) The locker box number (6) is added with "1" (BOX No.=6+1=7)

5) The locker box number (07) is judged to be smaller than the total number 8 of the locker boxes.

6) Judgement is made as to whether the locker box 07 is of the type M selected in the step (C). The locker box 07 is judged to be of the type M.

7) Judgement is made as to whether the door o the locker box 07 is closed. The door is judged to be closed.

8) Judgement is made as to whether the locker box 07 is occupied by an article. The locker box 07 is judged to be empty.

(E) The locker box 07 is unlocked (step E).

(F) The door of the locker box 07 is opened, and the baggage to be delivered is accommodated in the box and the door is closed to complete the delivery operation (step F).

(G) The baggage is ready to be taken-out by the resident of the house number 301, and the locker box number 07 is stored.

EXAMPLE 4

Another courier service agent D intends to deliver a baggage to a resident whose house number is 502.

(A) The agent D pushes the delivery key 16*a* (step A).

(B) The agent D pushes the house number 502 by the ten-keys 15, and further pushes the confirmation key 16*f* (step B).

(C) The agent D selects a locker box of the medium type M and pushes the selection key 16*g* corresponding to the type M (step C).

(D) Locker box retrieval (step D):

1) The locker box counter (CNT) is set to "0".

2) The counter value (CNT=0) is added with "1" (CNT=0+1=1).

3The counter value (CNT=1) is judged to be smaller than the total number 8 of the locker boxes.

4) The locker box number (8) is added with "1" (BOX No.=7+1=8)

5) The locker box number (08) is judged to be same as the total number 8 of the locker boxes.

6) Judgement is made as to whether the locker box 08 is of the type M selected in the step (C). The locker box 07 is judged to be of the type L.

7) Return to 2) to add the counter value (CNT=1) with "1" (CNT=1+1=2).

The counter value (CNT=2) is judged to be smaller than the total number 8 of the locker boxes.

9) The locker box number (8) is added with "1" (BOX No.=8+1=9).

10) The locker box number (09) is judged to be greater than the total number 8 of the locker boxes.

11) The locker box number is reset to "1".

12) Judgement is made as to whether the locker box 01 is of the type M selected in the step (C). The locker box 07 is judged to be of the type M.

13) Judgement is made as to whether the door of the locker box 01 is closed. The door is judged to be closed.

14) Judgement is made as to whether the locker box 01 is occupied by an article. The locker box 01 is judged to be empty.

(E) The locker box 01 is unlocked (step E).

(F) The door of the locker box 01 is opened, and the baggage to be delivered is accommodated in the box and the door is closed to complete the delivery operation (step F).

(G) The baggage is ready to be taken-out by the resident of the house number 502, and the locker box number 01 is stored.

In the event that the locker apparatus is to be used by a resident who intends to dispatch a baggage or the like article through a courier service agent or deliver clothes or the like to be washed by a laundry service agent, the procedures to be followed are substantially the same as in the above-mentioned examples.

As can be appreciated from the above explanation of the examples 1–4, once a locker box 01 of the type M has been used, the very same locker box 01 is designated only after a one-round use of all the remaining locker boxes 06 and 07 of the same type M. That is, in accordance with the present invention, an empty locker box of a desired type is automatically designated such that any one of the locker boxes of a same type, after it has been once used, can be designated only after subsequent use of all remaining locker boxes of the same type. Thus, all the locker boxes of a same type are used with a substantially completely uniform frequency.

It will be readily appreciated from the foregoing detailed description that, in accordance with the present invention, a locker box of selected type can be automatically designated for use in order to avoid the user's free choice and to allow all the locker boxes of the same type to be used with a substantially completely uniform frequency. It is thus possible to avoid use with non-uniform higher frequency of particular locker boxes only, to prevent premature damages of the locker boxes, and to thereby prolong the serviceable life of the entire apparatus.

Figure 5:
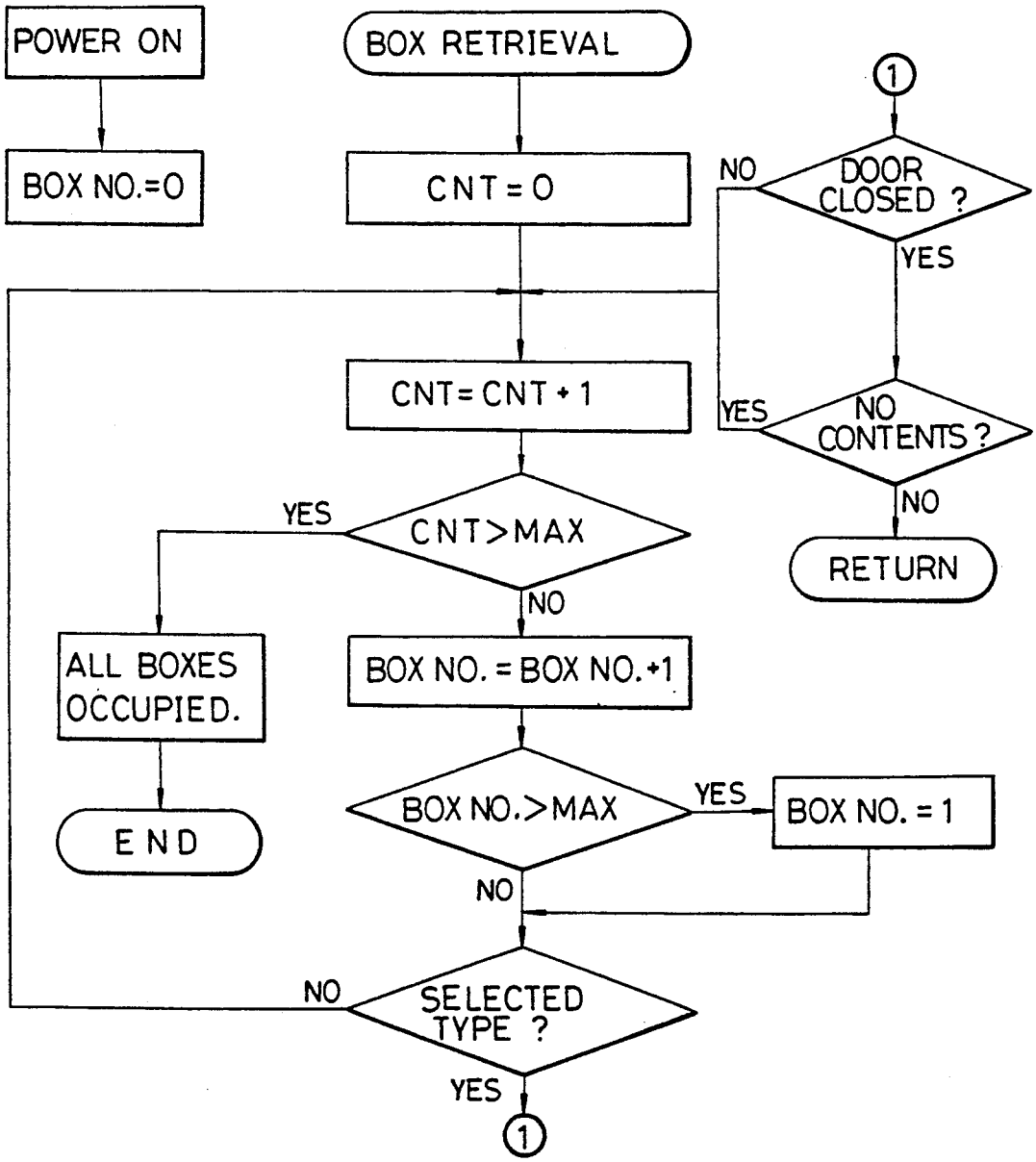
FIG. 5 is a flow chart showing the procedures for automatically designating the locker box to be used..

The present invention is not limited to the illustrated embodiment which has been explained by way of example, and various modifications and/or alterations may be made in particular, for example, to the locker box designation procedures as shown in FIG. 5, without departing from the scope of the invention.

What is claimed is:

1. An electric locker apparatus to be installed at a public space, comprising:

a plurality of locker boxes of at least one type, each locker box having a door with an electric lock device, and a sensor for detecting whether the relevant locker box is occupied by an article or empty;

means for automatically designating an empty locker box of a desired type such that any one of the locker boxes of a same type, after it has been once occupied by the article, can be designated only after subsequent occupation of all remaining locker boxes of the same type; and means for actuating the lock device of the designated locker box to unlock the door, thereby allowing the article to be accommodated in the designated locker box.

2. The apparatus as set forth in claim 1, including locker boxes of two or more types, further comprising means for manually selecting a desired type of the locker box to be occupied, depending upon the size of an article to be accommodated in a locker box.

3. The apparatus as set forth in claim 1, further comprising means for manually selecting one of a plurality of operation modes of the apparatus, including one operation mode wherein an article to be delivered to a registered user can be accommodated in a locker box, and another operation mode wherein the article delivered to the registered user and accommodated in the locker box can be taken-out by the registered user.

4. The apparatus as set forth in claim 3, further comprising means for manually inputting identification data of a registered user to whom an article is to be delivered.

5. The apparatus as set forth in claim 4, further comprising means for displaying identification data of the registered user to whom an article has been delivered and accommodated in a locker box.

6. The apparatus as set forth in claim 3, further comprising means for issuing a certificate only after all procedures have been completed to deliver an article to a registered user by accommodating the article in a locker box.

7. The apparatus as set forth in claim 1, further comprising means for manually selecting one of a plurality of operation modes of the apparatus, including one operation mode wherein an article to be delivered to a service agent can be accommodated in a locker box by a registered user, and another operation mode wherein the article accommodated in the locker box can be taken-out by the service agent.

8. An electric locker apparatus to be installed at a public space, comprising:

an electric power supply including a main switch;

a plurality of locker boxes of two or more types, each locker box having an electric lock device and a sensor for detecting whether the relevant locker box is empty or occupied by an article, said locker boxes being assigned with respective box numbers of successive natural numbers which are independent from the type of the locker box;

locker box type selection means for manually selecting the type of the locker box, depending upon the size of an article to be accommodated in a locker box;

locker box designation means for successively retrieving the locker boxes and designating an empty locker box of the selected type which is to be occupied by the article, such that any one of the locker boxes of a same type, after it has been once occupied by an article, is designated only after subsequent occupation of all remaining locker boxes of the same type; and control means for permitting the designating locker box of the selected type to be opened to accommodate an article, by controlling the relevant electric lock device upon coincidence of an input identification code with a data stored in the control means.

9. The apparatus as set forth in claim 8, further comprising means for manually selecting one of a plurality of operation modes of the apparatus, including one operation mode wherein an article to be delivered to a registered user can be accommodated in a locker box, and another operation mode wherein the article delivered to the registered user and accommodated in the locker box can be taken-out by the register user.

10. The apparatus as set forth in claim 9, further comprising mean for manually inputting identification data of a registered user to whom an article is to be delivered.

11. The apparatus as set forth in claim 10, further comprising means for displaying identification data of the registered user to whom an article has been delivered and accommodated in a locker box.

12. The apparatus as set forth in claim 9, further comprising means for issuing a certificate only after all procedures have been completed to deliver an article to a registered user by accommodating the article in a locker box.

13. The apparatus as set forth in claim 8, further comprising means for manually selecting one of a plurality of operation modes of the apparatus, including one operation mode wherein an article to be delivered to a service agent can be accommodated in a locker box by a registered user, and another operation mode wherein the article accommodated in the locker box can be taken-out by the service agent.

14. The apparatus as set forth in claim 8, wherein said locker box designation means comprises:

a locker box retrieving counter;

a locker box number counter;

means operative when a successively retrieved locker box is not of the selected type or is currently in use, for carrying out a first step wherein, starting from an initial count value "0" of the retrieving counter, a value "1" is successively added to the count value of the retrieving counter;

means operative when the number of the retrieved locker box exceeds the total number of the locker boxes, for indicating that no locker box is currently available;

means for carrying out a second step for temporarily designating a locker box, wherein count value of the locker box number counter is set to "0" when the electric main switch of the locker apparatus is turned-on, and the count value of the locker box number counter is added with "1" each time a locker box has been retrieved to store the locker box number of most recently designated locker box and read-out the stored locker box number upon a subsequent locker box retrieval, and wherein the count value of the locker box number counter is set to "1" when the count value of the locker box number counter exceeds total number of the locker boxes to continue addition of "1" to the count value of the locker box number counter;

means operative when the temporarily designated locker box is either occupied by an article or is of a type which is different from the selected one, for returning to said first step and adding "1" to the count value of the retrieving counter, and for successively retrieving the locker box numbers as many times as the count value of the locker box number counter exceeds the total number of the locker boxes; and means for definitely designating a locker box by confirming that the temporarily designated locker box is empty and is of a selected type.

15. An electric locker apparatus to be installed at a public space, comprising:

an electric power supply including a main switch;

a plurality of locker boxes of two or more types, each locker box having an electric lock device and a sensor for detecting whether the relevant locker box is empty or occupied by an article, said locker boxes being assigned with respective box numbers of successive natural numbers which are independent from the type of the locker box;

locker box type selection means for manually selecting the type of the locker box, depending upon the size of an article to be accommodated in a locker box;

locker box designation means for successively retrieving the locker boxes and designating an empty locker box of the selected type which is to be occupied by the article, such that any one of the locker boxes of a same type, after it has been once occupied by an article, is designated only after subsequent occupation of all remaining locker boxes of the same type; and control means for permitting the designated locker box of the selected type to be opened to accommodate an article, by controlling the relevant electric lock device upon coincidence of an input identification code with a data stored in the control means, said locker box designation means comprising:

a locker box retrieving counter;

a locker box number counter;

means operative when a successively retrieved locker box is not of the selected type or is currently in use, for carrying out a first step wherein, starting from an initial count value "0" of the retrieving counter, a value "1" is successively added to the count value of the retrieving counter;

means operative when the number of the retrieved locker box exceeds the total number of the locker boxes, for indicating that no locker box is currently available;

means for carrying out a second step for temporarily designating a locker box, wherein the count value of the locker box number counter is set to "0" when the electric main switch of the locker apparatus is turned-on, and the count value of the locker box number counter is added with "1" each time a locker box has been retrieved to store the locker box number of the most recently designated locker box and read-out the stored locker box number upon a subsequent locker box retrieval, and wherein the count value of the locker box number counter is set to "1" when the count value of the locker box number counter exceeds the total number of the locker boxes to continue the addition of "1" to the count value of the locker box number counter;

means operative when the temporarily designated locker box is either occupied by an article or is of a type which is different from the selected one, for returning to said first step and adding "1" to the count value of the retrieving counter, and for successively retrieving the locker box numbers as many times as the count value of the locker box number counter exceeds the total number of the locker boxes; and means for definitely designating a locker box by confirming that the temporarily designated locker box is empty and is of a selected type.

* * * * *